US012624876B2

(12) United States Patent
Knatt

(10) Patent No.: US 12,624,876 B2
(45) Date of Patent: May 12, 2026

(54) ICE MAKER WITH PRESSURE TRANSDUCERS

(71) Applicant: True Manufacturing Co. Inc., O'Fallon, MO (US)

(72) Inventor: Kevin Knatt, St. Louis, MO (US)

(73) Assignee: TRUE MANUFACTURING CO., INC., O'Fallon, MO (US)

( * ) Notice: Subject to any disclaimer, the term of this patent is extended or adjusted under 35 U.S.C. 154(b) by 55 days.

(21) Appl. No.: 17/586,365

(22) Filed: Jan. 27, 2022

(65) Prior Publication Data

US 2022/0268504 A1 Aug. 25, 2022

Related U.S. Application Data

(60) Provisional application No. 63/152,363, filed on Feb. 23, 2021.

(51) Int. Cl.
*F25B 49/02* (2006.01)

(52) U.S. Cl.
CPC ..... *F25B 49/022* (2013.01); *F25B 2400/12* (2013.01); *F25B 2600/0251* (2013.01);
(Continued)

(58) Field of Classification Search
CPC ..... F25B 49/022; F25B 2400/12; F25B 2600/0251; F25B 2700/1931; F25B 2700/1933; F25C 2400/14; F25C 2600/04
See application file for complete search history.

(56) References Cited

U.S. PATENT DOCUMENTS 3,698,204 A * 10/1972 Schlotterbeck ..... F25B 41/22 62/212
4,463,571 A * 8/1984 Wiggs ..... F25B 49/005 236/94

(Continued)

FOREIGN PATENT DOCUMENTS

CN 102483242 A 12/1996
CN 203672015 U 6/2014

(Continued)

OTHER PUBLICATIONS

Extended European Search Report from EP Application No. 22158341.2, dated Aug. 11, 2022, 13 pages.

(Continued)

*Primary Examiner* — Jonathan Bradford
(74) *Attorney, Agent, or Firm* — Stinson LLP

(57) ABSTRACT

An ice maker control system includes a low side pressure transducer on a suction line and a high side pressure transducer on a discharge line. The ice maker's refrigeration system is hermetically sealed and devoid of pressure taps for servicing gauges. The ice maker can display an indication of real-time suction or discharge pressure. The ice maker can store records of suction and discharge pressure over time and display time series data for suction and discharge pressure on the display. The ice maker can cycle the condenser fan based on the discharge pressure. An additional high pressure switch can shut off the compressor independently of the controller or transducers. During a pulldown routine, the ice maker refrains from delivering water to the ice formation device until the suction pressure is below a threshold.

27 Claims, 11 Drawing Sheets

(52) U.S. Cl.
CPC ..... *F25B 2700/1931* (2013.01); *F25B 2700/1933* (2013.01); *F25C 2400/14* (2013.01); *F25C 2600/04* (2013.01)

(56) References Cited

U.S. PATENT DOCUMENTS

| | | | | |
|---|---|---|---|---|
| 5,172,758 | A * | 12/1992 | Aoki | F25B 39/04 165/110 |
| 5,218,830 | A | 6/1993 | Martineau | |
| 5,237,834 | A * | 8/1993 | Grossel | F25C 1/25 141/113 |
| 6,334,320 | B1 | 1/2002 | Brown et al. | |
| 7,849,699 | B2 | 12/2010 | Allen | |
| 8,484,987 | B2 | 7/2013 | Ducharme et al. | |
| 10,502,472 | B2 | 12/2019 | Knatt | |
| 2004/0210419 | A1* | 10/2004 | Wiebe | F25B 49/005 702/182 |
| 2006/0086113 | A1* | 4/2006 | Errington | B60H 1/00764 62/133 |
| 2012/0031115 | A1 | 2/2012 | Mueller et al. | |
| 2012/0060529 | A1 | 3/2012 | Singh et al. | |
| 2015/0219377 | A1 | 8/2015 | Goel et al. | |
| 2018/0031266 | A1 | 2/2018 | Atchison et al. | |
| 2018/0031294 | A1 | 2/2018 | Olson, Jr. et al. | |
| 2019/0204798 | A1* | 7/2019 | Holaso | F24F 11/65 |

FOREIGN PATENT DOCUMENTS

| | | | | |
|---|---|---|---|---|
| CN | 111854320 | A | 10/2020 | |
| EP | 2309212 | A1 * | 4/2011 | F25B 49/005 |
| EP | 1872089 | B1 | 11/2015 | |
| EP | 2417406 | B1 | 3/2019 | |
| JP | S46-26931 | Y | 9/1971 | |
| JP | 2000039220 | A | 2/2000 | |
| JP | 3710922 | B2 | 10/2005 | |
| JP | 2006240657 | A | 9/2006 | |
| JP | 2006258393 | A | 9/2006 | |
| JP | 2010025410 | A | 2/2010 | |
| JP | H08338675 | A | 5/2012 | |
| JP | 2013253706 | A | 12/2013 | |
| JP | 2015014440 | A | 1/2015 | |
| JP | 2016200349 | A | 12/2016 | |
| JP | 2019500569 | A | 1/2019 | |
| JP | 2020034250 | A | 3/2020 | |
| JP | 2020143861 | A | 9/2020 | |
| WO | 2016183206 | A1 | 11/2016 | |
| WO | 2020174639 | A1 | 9/2020 | |

OTHER PUBLICATIONS

Extended European Search Report from EP Application No. 22158341.2, dated Nov. 9, 2022, 20 pages.

* cited by examiner

800

ICE MAKER WITH PRESSURE TRANSDUCERS

CROSS-REFERENCE TO RELATED APPLICATION

This application claims priority to U.S. Provisional Patent Application Ser. No. 63/152,363, filed Feb. 23, 2021, and entitled ICE MAKER, which is hereby incorporated by reference in its entirety for all purposes.

FIELD

The present disclosure generally relates to dedicated ice maker appliances of the type comprising a refrigeration system dedicated to the task of cooling water in an ice formation device into ice.

BACKGROUND

Numerous types of dedicated ice makers are in wide commercial and residential use. As compared with freezer-deployed ice makers, which cool water inside a freezer compartment that is simultaneously used to keep other goods frozen, dedicated ice makers include refrigerant systems that are dedicated to the task of cooling water in an ice formation device to make ice. Common types of dedicated ice makers include flow-down batch ice makers with a water distributor that direct water to flow down along the front side of a vertically oriented freeze plate, vertical spray ice makers that spray water upward into downwardly opening ice molds in a horizontal freeze plate, and nugget ice makers that cool water into ice inside a cylindrical tube containing an auger that pushes out nuggets of ice formed within the tube.

SUMMARY

In one aspect, an ice maker comprises an ice formation device in which to form ice. A water system is configured to deliver water to the ice formation device. A refrigeration system includes a compressor, a condenser, an evaporator, a thermal expansion device, and refrigerant passaging connection the compressor, the condenser, the evaporator, and the thermal expansion device. The evaporator is thermally coupled to the ice formation device to cool the ice formation device for forming at least some of the water delivered by the water system into ice. A control system is configured to control the refrigeration system and the water system to form ice in the ice formation device. The control system includes a controller, a low side pressure transducer fluidly connected to the refrigerant passaging upstream of the compressor, and a high side pressure transducer fluidly connected to the refrigerant passaging downstream of the compressor. The low side pressure transducer is configured to output to the controller a signal representative of a suction pressure of the refrigeration system and the high side pressure transducer configured to output to the controller a signal representative of a discharge pressure of the refrigeration system. The refrigeration system is hermetically sealed and is devoid of any pressure taps at which any servicing pressure gauge can be fluidly connected to the refrigerant passaging.

In another aspect, a method of servicing an ice maker comprises displaying an indication one of suction pressure and a discharge pressure on a display connected to the ice maker. Said indication of one of the suction pressure and the discharge pressure is based on a signal output from a pressure transducer connected to a hermetically sealed refrigeration system of the ice maker. A controller of the ice maker conducts an automated maintenance routine in response to a user input to the display and received by the controller. The user input instructs the controller to perform the automated maintenance routine to address a diagnosis made based on the displayed one of the suction pressure and the discharge pressure.

In another aspect, an ice maker comprises an ice formation device in which to form ice. A water system is configured to deliver water to the ice formation device. A refrigeration system includes a compressor, a condenser including a condenser fan, an evaporator, a thermal expansion device, and refrigerant passaging connecting the compressor, the condenser, the evaporator, and the thermal expansion device, the evaporator is thermally coupled to the ice formation device to cool the ice formation device for forming at least some of the water delivered by the water system into ice. A control system is configured to control the refrigeration system and the water system to form ice in the ice formation device. The control system includes a controller and a high side pressure transducer fluidly connected to the refrigerant passaging downstream of the compressor. The high side pressure transducer is configured to output to the controller a signal representative of a discharge pressure of downstream of the compressor. The controller is configured to cycle the condenser fan based on the output of the high side pressure transducer.

In another aspect, an ice maker comprises an ice formation device in which to form ice. A water system is configured to deliver water to the ice formation device. A refrigeration system includes a compressor, a condenser including a condenser fan, an evaporator, a thermal expansion device, and refrigerant passaging connecting the compressor, the condenser, the evaporator, and the thermal expansion device. The evaporator is thermally coupled to the ice formation device to cool the ice formation device for forming at least some of the water delivered by the water system into ice. A control system is configured to control the refrigeration system and the water system to form ice in the ice formation device. The control system includes a controller and a high side pressure transducer fluidly connected to the refrigerant passaging downstream of the compressor. The high side pressure transducer is configured to output to the controller a signal representative of a discharge pressure of downstream of the compressor. A high pressure switch is fluidly connected to the refrigerant tubing downstream of the compressor at a location spaced apart from the high side pressure transducer. The high pressure switch is configured to shutoff the compressor independently of the controller.

In another aspect, an ice maker comprises an ice formation device in which to form ice. A water system is configured to deliver water to the ice formation device. A refrigeration system includes a compressor, a condenser including a condenser fan, an evaporator, a thermal expansion device, and refrigerant passaging connecting the compressor, the condenser, the evaporator, and the thermal expansion device. The evaporator is thermally coupled to the ice formation device to cool the ice formation device for forming at least some of the water delivered by the water system into ice. A control system is configured to control the refrigeration system and the water system to form ice in the ice formation device. The control system includes a controller and a low side pressure transducer fluidly connected to the refrigerant passaging upstream of the compressor. The low side pressure transducer is configured to output to the controller a signal representative of a suction pressure upstream of the compressor. The controller is configured to direct a pulldown routine in which the controller activates the refrigeration system, refrains from using the water system to deliver water to the ice formation device until the signal output from the low side pressure transducer indicates that the suction pressure is below a threshold, and actuates the water system to deliver water to the ice formation device after the signal from the low side pressure transducer indicates that the suction pressure is below the threshold.

In another aspect, a method of using an ice maker comprises operating the ice maker to make ice. While operating the ice maker to make ice, at least one of a signal from a low side pressure transducer representative of suction line pressure and a signal from a high side pressure transducer representative of discharge line pressure is outputted. Based on at least one of the signal from the low side pressure transducer and the signal from the high side pressure transducer, a respective record of at least one of the suction line pressure and the discharge line pressure is stored over a period of time in memory. Based on the respective record stored in memory, an indication of at least one of the suction line pressure and the discharge line pressure over the period of time is displayed.

Other aspects will be in part apparent and in part pointed out hereinafter.

BRIEF DESCRIPTION OF THE DRAWINGS

Corresponding parts are given corresponding reference numbers throughout the drawings.

DETAILED DESCRIPTION

Figure 1:
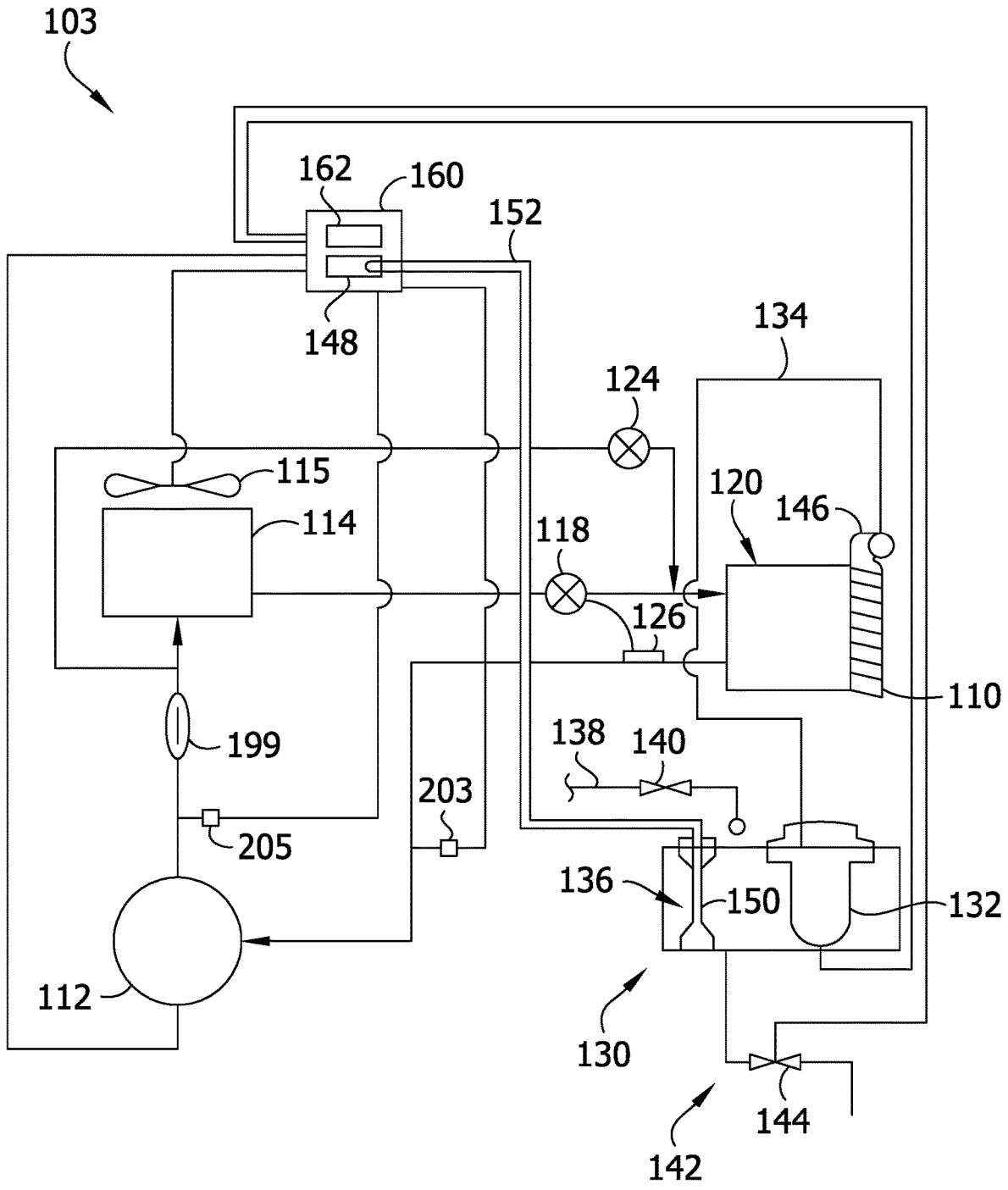
FIG. 1 is a schematic illustration of an ice maker.

Referring to FIG. 1, an exemplary embodiment of an ice maker is generally indicated at reference number 103. This disclosure pertains to dedicated ice makers, as opposed to freezer-deployed ice makers which cool water inside a freezer compartment that is simultaneously used to keep other goods frozen. Ice makers in the scope of this disclosure may broadly comprise an ice formation device on which water can form into pieces of ice, a water system for directing water onto the ice formation device, and a refrigeration system configured to directly cool the ice formation device to a temperature at which at least some of the liquid water present on the ice formation device will freeze into ice. In the illustrated embodiment, the ice maker is a batch ice maker of the type which has a generally vertically oriented freeze plate 110 that constitutes the ice formation device. Other types of ice makers such as nugget ice makers and vertical spray ice makers are also contemplated to be in the scope of this disclosure. In a nugget ice maker, the ice formation device is typically a chilled cylinder disposed inside an auger; and in a vertical spray ice maker, the ice formation device is typically a horizontally oriented freeze plate including ice piece molds open downward for receiving vertically sprayed water that forms into ice in the molds.

The refrigeration system of the ice maker 103 includes a compressor 112, a heat rejecting heat exchanger 114, a refrigerant expansion device 118 for lowering the temperature and pressure of the refrigerant, an evaporator 120 along the back side of the freeze plate 110, and a hot gas valve 124. The compressor 112 can be a fixed speed compressor or a variable speed compressor to provide a broader range of operational control possibilities. As shown, the heat rejecting heat exchanger 114 may comprise a condenser for condensing compressed refrigerant vapor discharged from the compressor 112. In other embodiments, e.g., in refrigeration systems that utilize carbon dioxide refrigerants where the heat of rejection is trans-critical, the heat rejecting heat exchanger is able to reject heat from the refrigerant without condensing the refrigerant. Hot gas valve 124 is selectively opened to direct warm refrigerant from the compressor 114 directly to the evaporator 120 to remove or harvest ice cubes from the freeze plate 110 when the ice has reached the desired thickness.

The refrigerant expansion device 118 can be of any suitable type, including a capillary tube, a thermostatic expansion valve, or an electronic expansion valve. In certain embodiments, where the refrigerant expansion device 118 is a thermostatic expansion valve or an electronic expansion valve, the ice maker 110 may also include a temperature sensor 126 placed at the outlet of the evaporator 120 to control the refrigerant expansion device 118. In other embodiments, where the refrigerant expansion device 118 is an electronic expansion valve, the ice maker 110 may also include a pressure transducer (not shown) placed at the outlet of the evaporator 120 to control the refrigerant expansion device 118 as is known in the art. In the illustrated embodiment, a condenser fan 115 is positioned to blow the gaseous cooling medium across the condenser 114. In an exemplary embodiment, the condenser fan 115 is a variable speed fan having a plurality of speed settings, including at least a normal speed and a high speed. The compressor 112 cycles a form of refrigerant through the condenser 114, expansion device 118, evaporator 120, and the hot gas valve 124, via refrigerant lines.

In the illustrated embodiment, the refrigeration system further comprises a high pressure switch 199 fluidly connected to the refrigerant tubing downstream of the compressor (on the high side or discharge line of the compressor). Those skilled in the art will appreciate that a high pressure switch activates (e.g., switches from open to closed or closed to open) at a certain threshold pressure, to thereby make or break a circuit connection. Conventional ice makers can sometimes include two high pressure switches on the discharge line of the compressor. In these types of conventional ice makers, a first pressure switch activates at a minimum threshold pressure required for energizing the condenser fan motor. Additionally, a second high pressure switch is used as a safety device, to turn off the device when an unsafe pressure condition occurs. In the illustrated ice maker 103, only a single high pressure switch 199 is included, which is configured to shutoff the compressor 112 when the discharge pressure exceeds a safety threshold. For reasons that will become apparent hereinafter, there is no pressure switch on the discharge line for activating the compressor fan motor in the illustrated ice maker 103. In other words, the refrigeration system includes only a single (preferably, UL-rated) high pressure switch for safety.

Referring still to FIG. 1, a water system of the illustrated ice maker 10 includes a sump 130, a water pump 132, a water line 134 (broadly, passaging), and a water level sensor 136. The water pump 132 could be a fixed speed pump or a variable speed pump to provide a broader range of control possibilities. The water system of the ice maker 103 further includes a water supply line 138 and a water inlet valve 140 for filling the sump 130 with water from a water source (e.g., a municipal water utility). The illustrated water system further includes a drain line 142 (also called, drain passaging or a discharge line) and a drain valve 144 (e.g., purge valve, drain valve; broadly, a purge device) disposed thereon for draining water from the sump 130. The sump 130 may be positioned below the freeze plate 110 to catch water coming off of the freeze plate such that the relatively cool water falling from the freeze plate may be recirculated by the water pump 132. The water line 134 fluidly connects the water pump 132 to a water distributor 146 above the freeze plate. During an ice batch production cycle, the pump 132 is configured to pump water through the water line 134 and through the distributor 146. The distributor is configured to distribute the water imparted through the distributor 146 evenly across the front of the freeze plate 110 so that the water flows downward along the freeze plate and any unfrozen water falls off of the bottom of the freeze plate into the sump 130.

In an exemplary embodiment, the water level sensor 136 comprises a remote air pressure transducer 148. It will be understood, however, that any type of water level sensor may be used in the ice maker 103 including, but not limited to, a float sensor, an acoustic sensor, or an electrical continuity sensor. The illustrated water level sensor 136 includes a fitting 150 that is configured to couple the sensor to the sump 130. The fitting 150 is fluidly connected to a pneumatic tube 152. The pneumatic tube 152 provides fluid communication between the fitting 150 and the air pressure transducer 148. Water in the sump 130 traps air in the fitting 150 and compresses the air by an amount that varies with the level of the water in the sump. Thus, the water level in the sump 130 can be determined using the pressure detected by the air pressure transducer 148. Additional details of exemplary embodiments of a water level sensor comprising a remote air pressure transducer are described in U.S. Patent Application Publication No. 2016/0054043, which is hereby incorporated by reference in its entirety.

Figure 2:
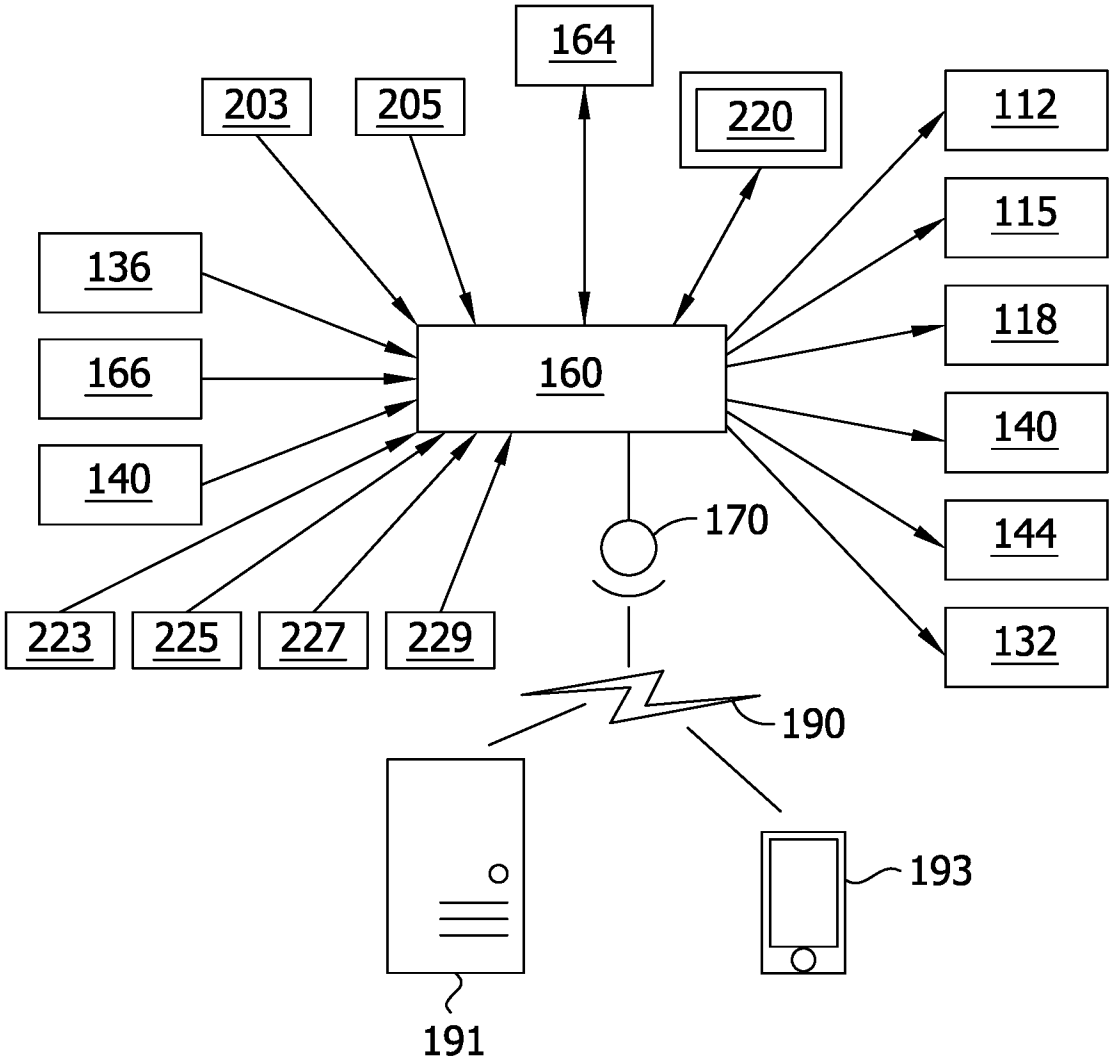
FIG. 2 is schematic block diagram of a control system of the ice maker.

Referring to FIGS. 1 and 2, the ice maker 103 includes a controller 160 (e.g., a "local controller" or an "appliance controller"). The controller 160 includes at least one processor 162 for controlling the operation of the ice maker 103, e.g., for controlling at least one of the refrigeration system and the water system. The processor 162 of the controller 160 may include a non-transitory processor-readable medium storing code representing instructions to cause the processor to perform a process. The processor 162 may be, for example, a commercially available microprocessor, an application-specific integrated circuit (ASIC) or a combination of ASICs, which are designed to achieve one or more specific functions, or enable one or more specific devices or applications. In certain embodiments, the controller 160 may be an analog or digital circuit, or a combination of multiple circuits. The controller 160 may also include one or more memory components 164 (FIG. 2) for storing data in a form retrievable by the controller. The controller 160 can store data in or retrieve data from the one or more memory components.

Referring to FIG. 2, in various embodiments, the controller 160 may also comprise input/output (I/O) components to communicate with and/or control the various components of ice maker 103. In certain embodiments, the controller 160 may receive inputs such as, for example, one or more indications, signals, messages, commands, data, and/or any other information, from the water level sensor 136, a harvest sensor 166 for determining when ice has been harvested, an electrical power source (not shown), an ice level sensor 140 for detecting the level of ice in a bin (not shown) below the ice maker 103, and/or a variety of sensors and/or switches including, but not limited to, pressure transducers, temperature sensors, acoustic sensors, etc. Notably, the illustrated control system includes an integrated low side pressure transducer 203 and high side pressure transducer 205 that, as will be explained in further detail below, are configured to output (analog) signals to the controller 160 representative of refrigerant pressures upstream and downstream of the compressor 112 (e.g., the line pressure of the suction line and discharge line, respectively). Further, the illustrated control system comprises an evaporator temperature sensor 223 configured to output a signal representative of the temperature of the evaporator 120, an air temperature sensor 225 configured to output a signal representative of the temperature of air inside the ice maker 103, a water inlet temperature sensor 227 configured to output a signal representative of the temperature of water imparted into the ice maker, and a sump temperature sensor 229 configured to output a signal representative of a temperature of water in the sump 130.

In various embodiments, based on the above-described inputs and predefined control instructions stored in the memory components 164, the controller 160 controls the ice maker 103 by outputting control signals to controllable output components such as the compressor 112, the condenser fan 115, the refrigerant expansion device 118, the hot gas valve 124, the water inlet valve 140, the drain valve 144, and/or the water pump 132. Such control signals may include one or more indications, signals, messages, commands, data, and/or any other information to such components.

The control system further comprises a network interface 170 configured to connect the appliance 103 to a client-server network 190 for communication with the remote application server 191. In other words, the network interface 170 is configured to provide communication between the local controller 160 of the ice maker 103 and the remote asset server 191 (broadly, a remote device). An exemplary embodiment of communications architecture for use in an asset management system for appliances is described in greater detail in U.S. Pat. No. 9,863,694, which is hereby incorporated by reference in its entirety. The illustrated network interface 170 comprises a wireless transceiver such as a cellular data transceiver or a Wi-Fi transceiver. Other types of network interfaces (e.g., hardwired internet ports, etc.) can also be used without departing from the scope of the disclosure. In one or more embodiments, the network interface 170 is broadly configured to pass operating data from the ice maker 103 to the remote server 191 and to pass commands from the server to the ice maker. In the illustrated embodiment, the remote server 191 is configured to communicate (e.g., via the internet) with one or more webconnected mobile devices 193 (broadly, remote devices), e.g., smartphones, tablet computers, or laptop computers.

Suitably, a user can run a software application on the mobile device 193 that enables communication with the ice maker 103 via the remote server 191 and the network 190. For instance, as will be explained in further detail below, the mobile device 193 can display real-time operating data that is sent from the ice maker 103 to the remote server 191 and from the remote server to the user device. Furthermore, the mobile device 193 may be configured to display a record of historical operating data sent from the remote server 191. In one or more embodiments, the record of the historical operating data is sent from the ice maker 103 to the remote server 191 as requested by the user device. In certain embodiments, the remote server 191 is configured to store a record of real time operating data sent by the ice maker 103 so that it may be provided to the mobile device 193 upon request without querying the ice maker 103 for the data.

As mentioned above, the illustrated ice maker 103 comprises a low side pressure transducer 203 fluidly connected to the suction line of the refrigerant passaging (upstream of the compressor 112 and downstream of the evaporator 120) and a high side pressure transducer 205 fluidly connected to the discharge line of the refrigerant passaging (downstream of the compressor and upstream of the condenser 114). The low side pressure transducer 203 is configured to output to the controller 160 a signal (e.g., an analog signal) representative of a suction pressure (broadly, a low side pressure). Likewise, the high side pressure transducer 205 is configured to output to the controller 160 a signal (e.g., an analog signal) representative of a discharge pressure (broadly, a high side pressure).

Throughout this disclosure "pressure transducers" are distinguished from "pressure switches" in that pressure transducers produce a signal responsive to pressure that gradually changes in response to gradual changes in the line pressure. That is, pressure transducers have a pressure range and are configured to output analog signals that vary with line pressure throughout the entire pressure range. So for example, in one or more embodiments, the pressure transducer will output a voltage X (broadly, an output signal characteristic) that varies as a function of line pressure P, e.g., the voltage X could be proportional to or inversely proportional to line pressure. So in one embodiment, the pressure transducer could be configured to: at a line pressure P1, output an electrical signal with a voltage X1; at a line pressure P2, output an electrical signal with a voltage X2; at a line pressure P3, output an electrical signal with a voltage X3; at a line pressure P4, output an electrical signal with a voltage X4; and at a line pressure P5, output an electrical signal with a voltage X5: wherein $X1<X2<X3<X4<X5$ when $P1<P2<P3<P4<P5$. Thus, it can be seen that "pressure transducers" in the scope of this disclosure are distinguished from conventional pressure switches used in past ice makers.

The illustrated pressure transducers 203, 205 are pre-manufactured, permanent components of the refrigeration system, not gauges that temporarily couple to the refrigeration system for purposes of diagnostic testing during a service call. In an exemplary embodiment, each of the pressure transducers 203, 205 is incorporated into the refrigeration system in a hermetically sealed fashion. Thus, in one or more embodiments, the refrigeration system of the ice maker 103 is entirely hermetically sealed. Such a hermetically sealed refrigeration system is devoid of any pressure taps at which a servicing pressure gauge can be fluidly connected to the refrigerant passaging.

In one or more embodiments, the hermetically sealed refrigeration system is charged with natural gas refrigerant. In an exemplary embodiment the refrigerant is r290. In certain embodiments, the natural gas refrigerant has a total charge of less than 150 g. Other types of refrigerants and levels of refrigerant charge could also be used without departing from the scope of the disclosure.

Figure 3:
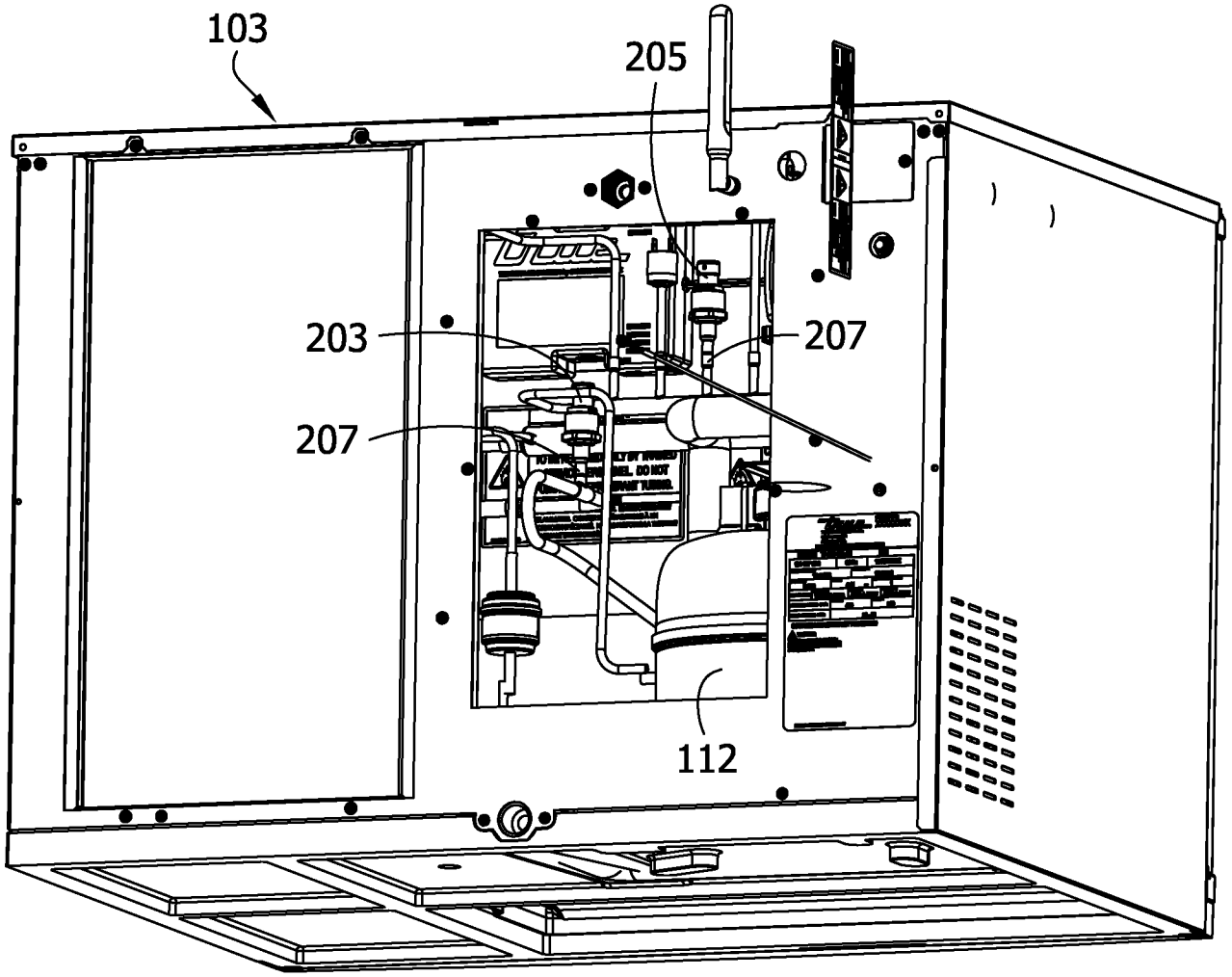
FIG. 3 is a rear perspective of the ice maker with a service access panel removed.
Figure 4:
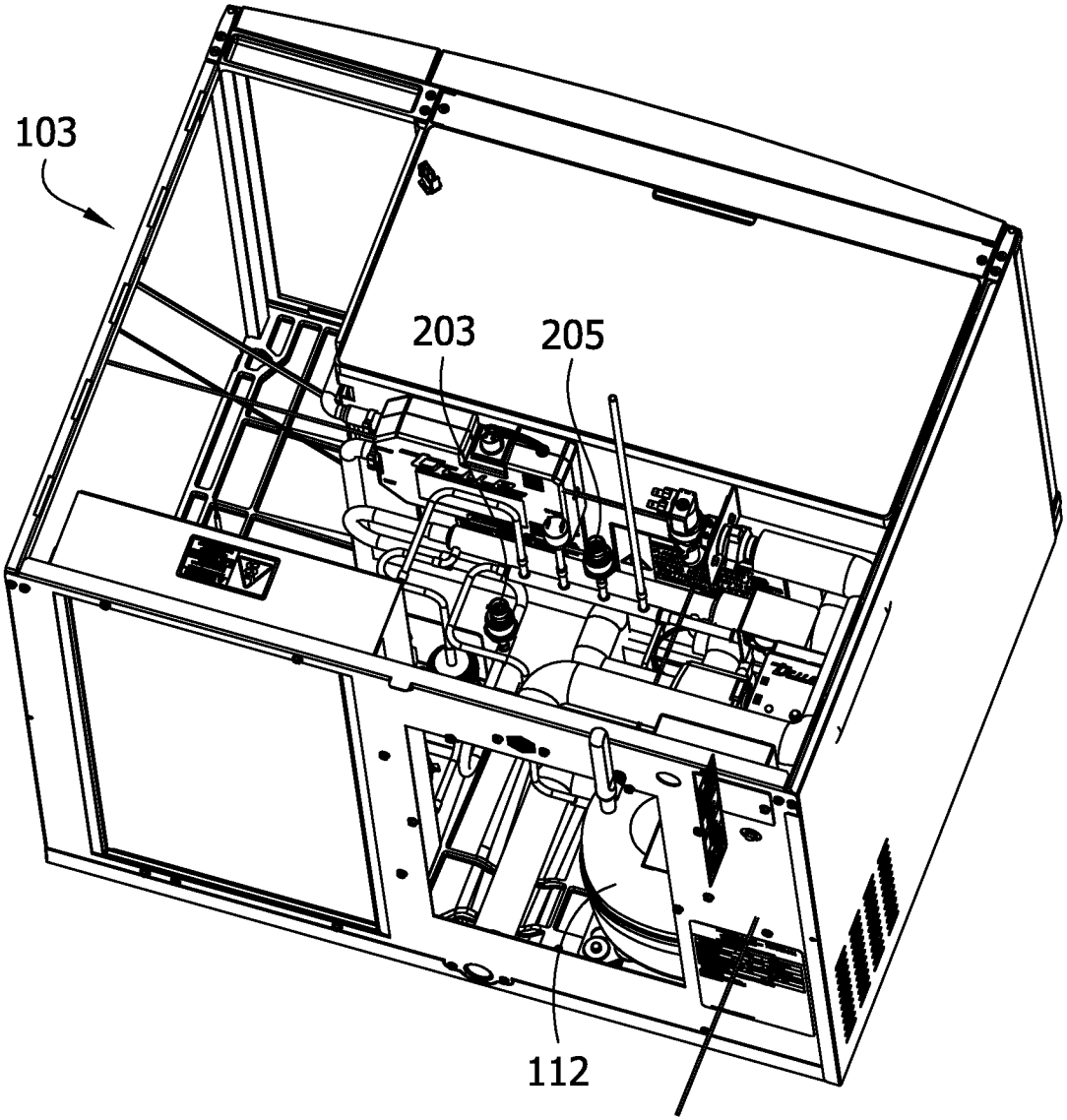
FIG. 4 is a top perspective of the ice maker with a top wall removed.
Figure 5:
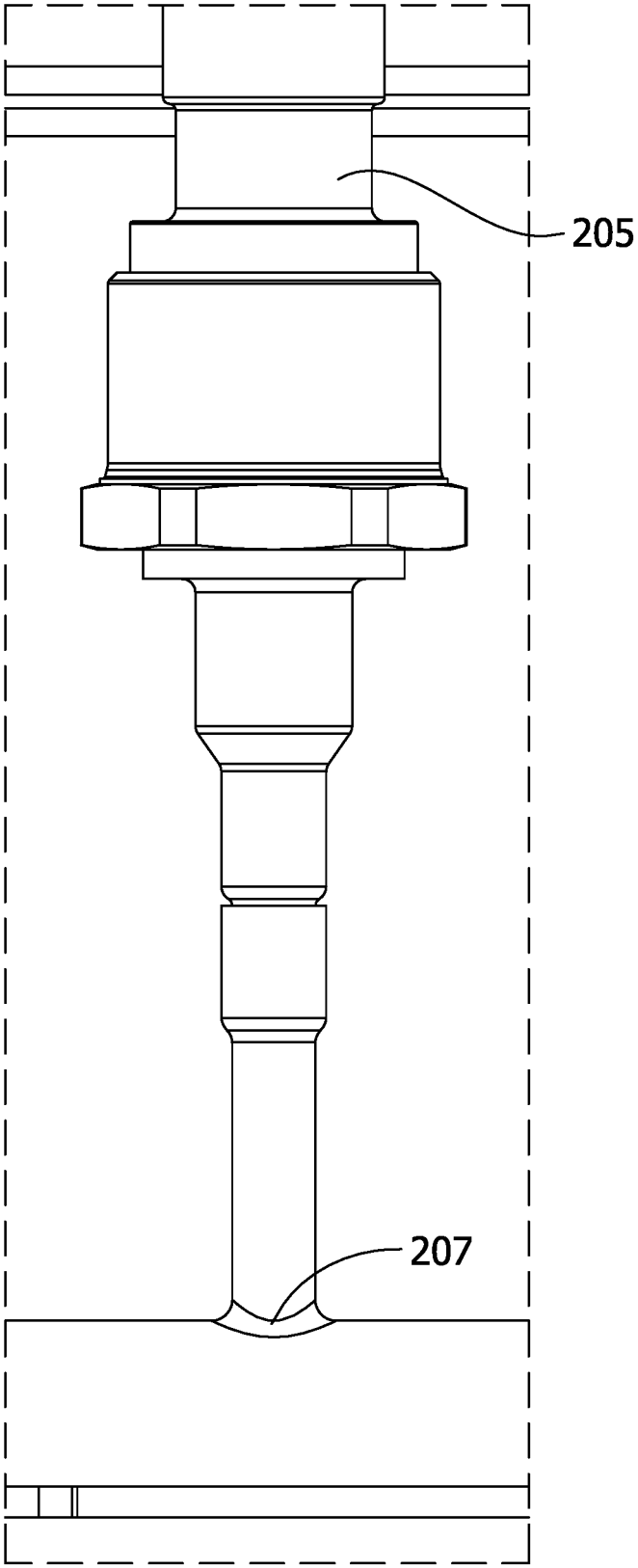
FIG. 5 is an enlarged view of a pressure transducer of the ice maker.

Referring to FIGS. 3-5, in the illustrated embodiment, each of the high side pressure transducer 205 and the low side pressure transducer 203 is connected to the refrigerant passaging by a respective tee joint 207. In one or more embodiments, each of the high side pressure transducer 205 and the low side pressure transducer 203 is connected to the refrigerant tubing by a brazed joint 207. The refrigerant passaging suitably comprises copper tubing. In the illustrated embodiment, each pressure transducer is connected to the tubing by a copper tee joint fitting 207 that is brazed into the refrigerant line.

Conventional refrigeration systems are formed with integrated pressure taps to allow a servicing technician to connect one or more pressure gauges to the refrigeration system to run diagnostic testing on the system. However, the inventors have recognized that these pressure taps can become leak points. Moreover, connecting pressure gauges to the refrigeration system inherently causes at least a small amount of refrigerant charge to bleed into the gauges. In conventional ice makers, this relatively small loss of charge has been viewed as mostly inconsequential to the performance of the ice maker. However, the inventors have recognized that when an ice maker uses a natural gas refrigeration system at a low charge (e.g., 150 g charge or less), the loss of even a few grams of refrigerant can substantially detract from performance and efficiency. Accordingly, the ice maker 103 has eliminated all pressure taps from the refrigeration system and instead incorporates the above-described pressure transducers 203, 205 in a hermetically sealed system. The inventors believe that this will significantly reduce the incidences of refrigerant leaks, and in the vast majority of cases, result in ice makers maintaining essentially 100% refrigerant charge over their entire lifespans.

The inventors have recognized that, to optimize ice maker performance, conventional pressure switches must be tailored for every specific ice maker product in a manufacturer's product line. For example, across a full line of ice makers, any differences in the relative sizes of compressor and evaporator will yield changes in the optimum refrigerant pressures for conducting an ice batch production process. Accordingly, any pressure switch that is used for controlling aspects of the ice batch production process should be engineered to activate at a particular pressure chosen based on the specific configuration of the product in question. For a manufacturer, optimizing the pressure-based control of each of its ice makers requires maintaining and properly deploying an inventory of numerous pressure switches. By contrast, the pressure transducers 203, 205 disclosed above can be used across a full line of dedicated ice makers. Moreover, whereas pressure switches can only perform at one specific, pre-engineered pressure, the illustrated pressure transducers can be used for numerous pressure-based control functions at different pressure thresholds within the operating ranges of the transducers. Furthermore, if the characteristics of the ice maker change over time, pressure set points and thresholds stored in memory can easily be reconfigured by changing the values stored in memory to adjust the pressure-based control parameters to account for the changes observed in the ice maker. These types of performance adjustments are not possible with conventional pressure switches.

The inventors also believe that the pressure transducers 203, 205 offer advantages over conventional temperature control devices. Many conventional ice makers include thermistors within the refrigeration system. These thermistors output signals that vary with the temperature of the refrigerant tubing. However, the temperature of the refrigerant tubing lags the temperature of the refrigerant. By contrast, the pressure transducers 203, 205 make a direct measurement of the line pressure of the refrigerant. In comparison with thermistors, the inventors believe that the pressure transducers 203, 205 may be more accurate and more responsive, and therefore may produce better control inputs for controlling certain aspects of the ice maker 103.

Exemplary methods of using the ice maker 103 will now be briefly described. First, this disclosure provides a general overview of how the ice maker 103 conducts an ice batch production process. Subsequently, this disclosure describes exemplary ways in which the control system uses the outputs of the low side pressure transducer 203 and the high side pressure transducer 205 that facilitate these ice batch production processes.

In general, the illustrated ice maker 103 is configured to conduct consecutive ice batch production cycles. Each ice batch production cycle comprises steps of freezing the ice (a freeze step), harvesting the ice (a harvest step), and filling the sump 130 (a fill step). At least some of the ice batch production cycles comprise steps of purging hard water from the sump 130 after a batch of ice is formed and before the sump is refilled (a purge step).

During the freeze step, the refrigeration system is operated to cool the freeze plate 110. At the same time, the pump 132 circulates water from the sump 130 through the water line 134 and further through the distributor 146. The distributor 146 distributes water along the top portion of the freeze plate 110. As the water flows down the front of the freeze plate 110, some of the water freezes into ice, forming ice pieces on the freeze plate of gradually increasing thickness. The unfrozen water falls off of the freeze plate 110 back into the sump 130.

When the ice reaches a thickness that is suitable for harvesting, the controller 160 switches from the freeze step to the ice harvest step. The pump 132 is turned off and the hot gas valve 124 is opened to redirect hot refrigerant gas to the evaporator 120. The hot gas warms the freeze plate 110, causing the ice to melt. The melting ice falls from the freeze plate into an ice bin (not shown) below. The hot gas valve 124 is closed after the ice has fallen from the freeze plate, as indicated by the harvest sensor 166.

Before beginning another ice batch production cycle, the sump 130 must be refilled to make up for the water consumed in the previous batch of ice. Thus, before beginning a subsequent freeze step, the controller 160 opens the water inlet valve 140 to let new supply water into the sump 130. The controller 160 closes the water inlet valve 140 when the water level sensor 136 provides an indication to the controller that the water level in the sump 130 reaches the desired ice making water level.

As can be seen from above, after each freeze step is complete cold water in the sump has drawn down from the ice making water level to the end-of-circulation water level, which typically leaves some water remaining in the sump. For energy efficiency purposes, it is desirable to maintain a relatively large volume of cold water in the sump 130 at the end-of-circulation level. The sump water functions as a cold reservoir and chills the new supply water that fills the sump from the end-of-circulation water level to the ice making water level. At least periodically, it is beneficial to purge a portion of the water from the sump 130. This is advantageous because, during the freeze step, as the water flows down the front of the freeze plate 110, impurities in the water such as calcium and other minerals in solution will remain in solution with the liquid water as purer water freezes. Thus, during each freeze step, the concentration of impurities in the water will increase. To counteract this phenomenon, the controller 160 will periodically conduct a purge step by opening the drain valve 144 to purge a portion of the residual water from the sump 130. The controller 160 directs the drain valve 144 to close when the water level sensor 136 provides an indication to the controller that the water level in the sump 130 reaches the desired purge level. The drain valve 144 is one suitable type of purge mechanism but other types of purge mechanisms (e.g., active drain pumps) can also be used to execute the above-described purge step without departing from the scope of the disclosure.

In conventional ice makers, when there is demand for ice after a lengthy period of inactivity, the ice maker is typically configured to respond to the demand by initiation an ice batch production cycle of the type described above. That is, the conventional ice maker fills the sump as needed and begins circulating the water over the freeze plate as soon as the refrigeration system is activated. However, when the ice maker initially begins to make ice after a period of inactivity such that the ice formation device is above freezing temperature, immediately directing water over the freeze plate in this fashion can lead to problems. For example, when the freeze plate is not sufficiently cooled to freeze the initial portion of water that is directed onto the freeze plate, there is a tendency for water to splash off the freeze plate in an uncontrolled manner. The splashing can lead to compounding issues because ice batch production cycles are often controlled based on a float switch in the sump. The splashed water is lost from the sump, and so the controls treat this drawdown in water level as if it were caused by water freezing into ice. Splash-out can cause an ice maker to begin a harvest step too soon, before a sufficient amount of ice has formed on the freeze plate. This, in turn, can lead to incomplete or improper harvest, which creates additional problems for the next batch of ice.

To mitigate against splash-out, some ice makers employ pulldown timers that delay activation of a water pump until the refrigeration system has been run for a predetermined amount of time after startup. However, the inventors have recognized that these timers are often mistimed to the actual conditions of the ice maker. For instance, in high ambient temperature conditions, it might take the ice maker longer than expected to pull down the freeze plate to the desired temperature. In this scenario, the timer would not allow for sufficient cooling of the freeze plate to prevent water from splashing when the water pump kicks on after the predetermined interval elapses. Conversely, timers that run longer than necessary are inefficient. Further, the inventors have recognized that conventional temperature sensors are not reliable indicators of pulldown completion because of the lack of load on the evaporator during pulldown. Accordingly, as explained below, the inventors have employed the low side pressure transducer 203 in a pulldown control method 700 (FIG. 6) that mitigates against splashing after initial pulldown.

Figure 6:
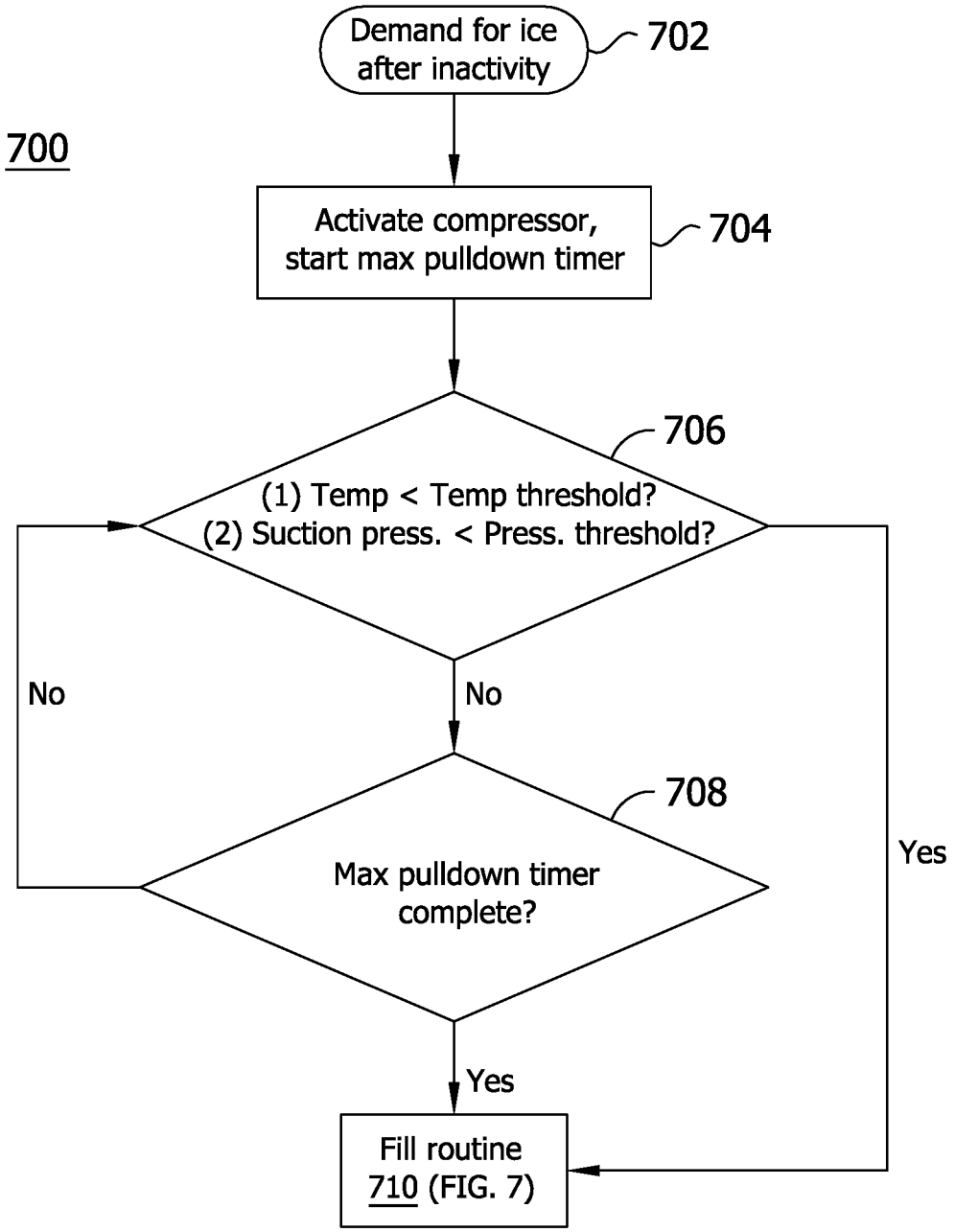
FIG. 6 is a flow chart illustrating the steps and decision points of a pulldown method implemented by the ice maker.

Referring to FIG. 6, in an exemplary embodiment of a pulldown control method 700, the controller 160 is generally configured to actuate the water system to deliver water to the freeze plate 110 based on the output of the low side pressure transducer 203. The starting point 702 for the method 700 is when there is a demand for ice after a period of inactivity. At step 704, the controller 160 activates the compressor 112 and starts a pulldown timer. The pulldown timer sets a maximum amount of time that the ice maker 103 will remain in the pulldown control method before switching to ice batch production. This timer is intended as a backup control input in the event that the characteristics of the refrigeration system change (e.g., due to scale, etc.) such that the low side pressure threshold discussed below is no longer indicative of the appropriate time to terminate pulldown.

At decision point 706, the controller makes two assessments. First, the controller 160 reads the output of the temperature sensor 126 at the evaporator outlet to determine whether the temperature at the outlet of the evaporator 120 is below a threshold. This temperature threshold is not intended to indicate pulldown completion because, as explained above, evaporator outlet temperature is not a reliable indication of pulldown completion since there is no load on the evaporator 120. Instead, the threshold is set to indicate that pulldown has begun. In other words, the threshold indicates that the refrigerant cycling through the refrigeration system is beginning to undergo the phase change required for making ice. In one or more embodiments, the threshold temperature in step 706 is in an inclusive range of from about 28° F. to about 36° F. During pulldown, once the evaporator outlet temperature crosses the temperature threshold, it will remain below the threshold for the remainder of the pulldown process. As to the second inquiry at decision point 706, the controller 160 reads the output of the low side pressure transducer 203 and determines whether it indicates the suction pressure is less than a threshold pressure indicative of pulldown being complete. In one or more embodiments, the threshold pressure in step 706 is in an inclusive range of from about 30 psi to about 40 psi. These ranges for pressure thresholds have been found suitable for r290 refrigerant systems. Those skilled in the art will understand, however, that the refrigeration systems using other types of refrigerants will require different pressure thresholds. The inventors have recognized that low side pressure can be a very reliable indicator of pulldown for a given ice maker. Hence, in decision point 706, the second inquiry into whether the suction pressure is below a predetermined threshold pressure is the primary trigger for completing the pulldown routine 700.

It is contemplated that, in one or more embodiments, the decision point for triggering the completion of the pulldown routine can consider the low side pressure without considering the evaporator outlet temperature. However, the temperature assessment at decision point 706 addresses scenarios in which the activation of the compressor 112 pulls an initial and temporary vacuum on the suction line before pulldown is meaningfully underway. The inventors have observed this behavior and recognize that it could falsely satisfy a strict pressure-based trigger for pulldown completion, before pulldown is actually complete. It is contemplated that other ways of addressing a momentary low pressure condition on the suction line upon compressor activation may be used without departing from the scope of the disclosure. For instance, in one or more embodiments, the controller runs a delay timer after activating the compressor and does not begin comparing the low side pressure output to the pulldown completion threshold until the delay timer has run.

Figure 7:
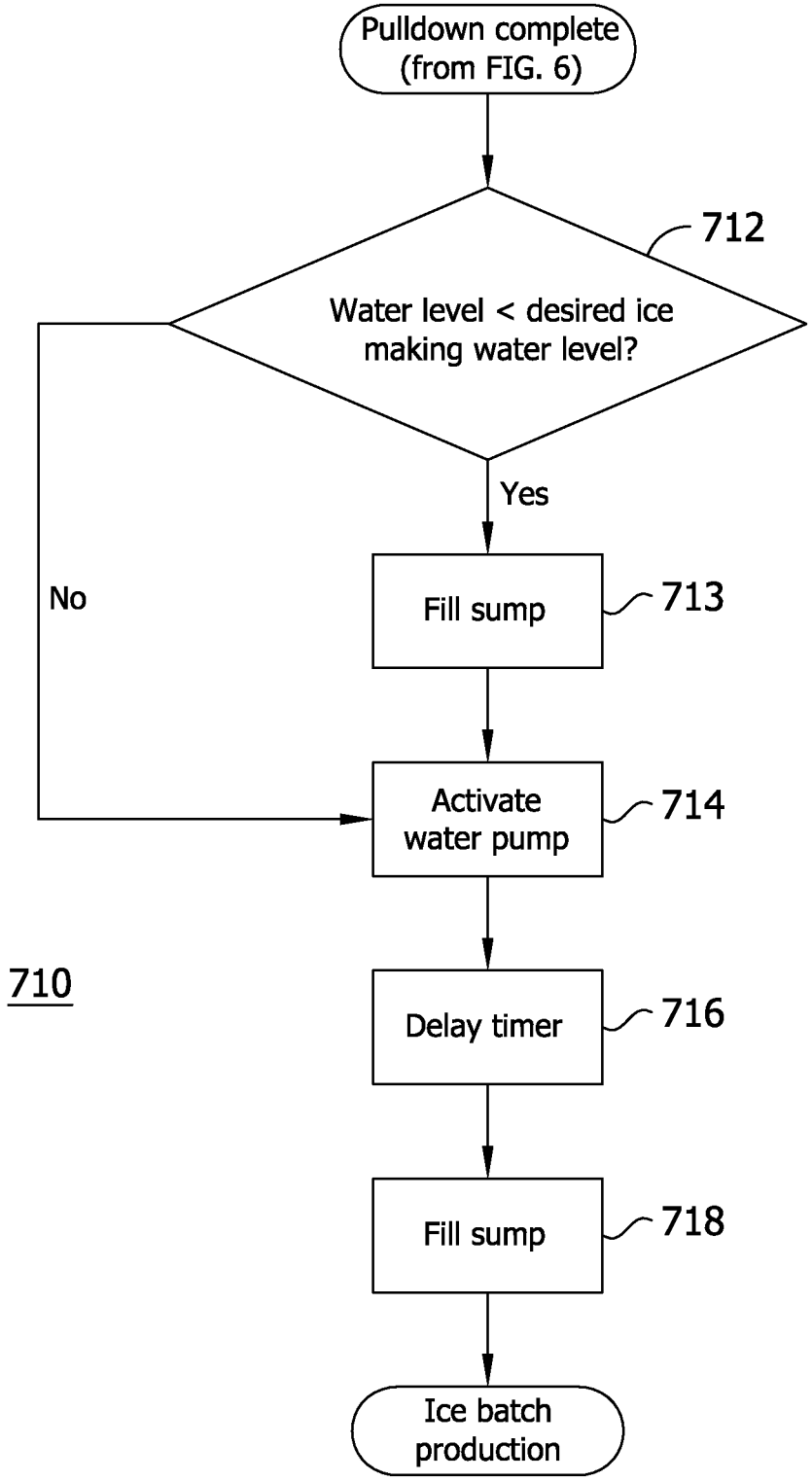
FIG. 7 is a flow chart illustrating the steps and decision point of a fill routine of the pulldown method of FIG. 6.

In the illustrated embodiment, if the answer to either of the first and second inquiries in the decision point 706 is 'no,' the method proceeds to another decision point 708 at which the controller determines whether the maximum allotted time for pulldown has been exceeded. If not, the method 700 returns to decision point 706. Decision points 706 and 708 repeat until either (I) the answer to both questions in decision point 706 is true or (II) the maximum allotted time for pulldown is exceeded. Subsequently, the controller executes a fill routine 710 shown in FIG. 7 and begins making ice.

In the illustrated embodiment, the fill routine 710 begins with a decision point 712 at which the controller determines based on the output of the water level sensor 136 whether the water in the sump is less than a desired ice making water level. If not, the controller 160 activates the water pump 132 (step 714). If the amount of water in the sump is less than the desired ice making water level, before executing activating the water pump in step 714, the controller first fills the sump 130 by opening the water inlet valve 140 until the output of the water level sensor 136 indicates that the water level in the sump is at the desired ice making water level (step 713). After activating the pump in step 714, in the illustrated embodiment, the controller 160 is configured to run a delay timer and wait for a predetermined delay time to lapse (step 716). This causes some of the water in the sump 130 to begin circulating through the water passaging, which can cause the level of water in the sump to lower after pulldown. After the delay timer lapses, the controller 160 again activates the inlet valve 134 to fill the sump to the desired ice making water level and proceeds to make ice.

Figure 8:
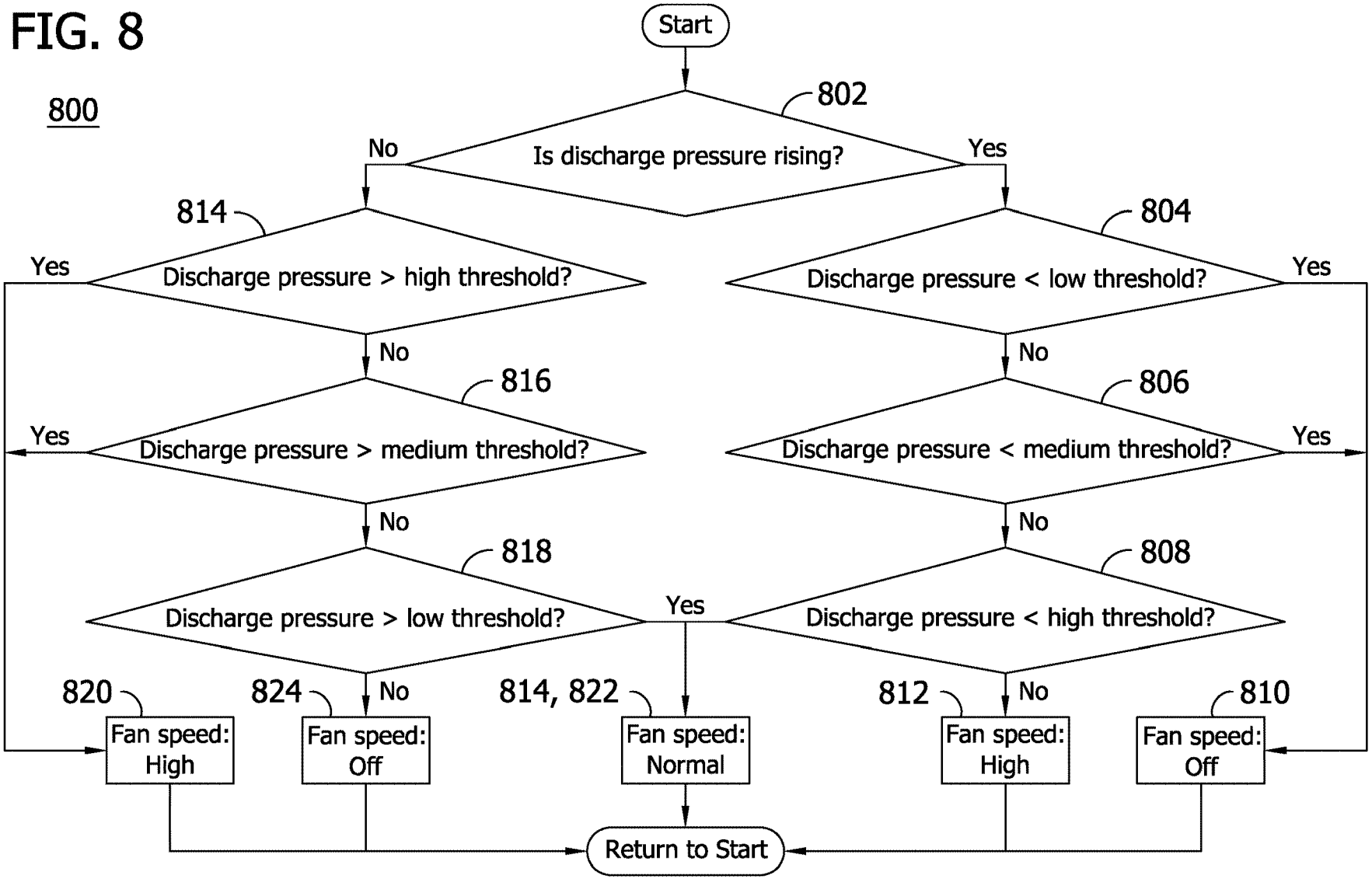
FIG. 8 is a flow chart illustrating the steps and decision points of a fan cycling method implemented by the ice maker.

Turning now to FIG. 8, the ice maker 103 is also configured to use the high side pressure transducer 205 to execute a condenser fan cycling method 800 anytime the ice maker is making ice. In general, the fan cycling method 800 enables the controller to cycle the condenser fan 115 based on the output of the high side pressure transducer 205 to maintain discharge pressure within an optimum operating range for the ice maker 103. For every ice maker, there is an optimum pressure range for the discharge pressure. When the refrigeration system is in use, discharge pressure can be adjusted by controlling the condenser fan 115. Conventional ice makers execute fan controls that cycle the condenser fan on and off according a predefined control scheme (e.g., based on a timer, a thermistor, or a pressure switch). However, the inventors have recognized that prior art fan cycling routines are only effective in a limited range of ambient conditions. Furthermore, the prior art fan cycling routines are prone to overshoot and undershoot, often yielding discharge pressures outside the intended operating range.

The inventors have recognized that the output of the high side pressure transducer 205 provides a more robust control input for controlling the condenser fan 115. Thus, in the method 800, the controller 160 uses the output of the high side pressure transducer 205 to control the condenser fan 115. In the illustrated embodiment, the condenser fan motor is a variable speed motor configured to drive the fan 115 to rotate a plurality of different speeds, including at least one 'normal' speed and at least one 'high' speed that is greater than the at least one normal speed. As explained more fully below, the controller 160 is configured to adjust the speed of the condenser fan 115 based on the output of the high side pressure transducer 205. In particular, the controller 160 is configured to selectively adjust the fan between a high speed, a normal speed, and off based on the output of the high side pressure transducer 205.

According to the method 800, at a first decision point 802, the controller 160 determines whether the output of the high side pressure transducer 205 indicates that the discharge pressure is rising or falling. The controller 160 is configured to adjust the condenser fan 115 differently depending on whether the discharge pressure is determined to be rising or falling. If the discharge pressure is determined to be rising at decision point 802, in consecutive decision points 804, 806, 808, the controller 160 determines whether the output of the high side pressure transducer 205 indicates the discharge pressure is above a low pressure threshold, a medium pressure threshold, and a high pressure threshold, wherein the low pressure threshold<the medium pressure threshold<high pressure threshold. In one or more embodiments, the low pressure threshold is in an inclusive range of from about 140 psi to about 160 psi; the medium pressure threshold is in an inclusive range of from about 170 psi to about 190 psi; and the high pressure threshold is in an inclusive range of from about 220 psi to about 250 psi. These ranges for pressure thresholds have been found suitable for r290 refrigerant systems. Those skilled in the art will understand, however, that the refrigeration systems using other types of refrigerants will require different pressure thresholds.

If the discharge pressure is rising but below either of the low pressure threshold and the medium pressure threshold, the controller 160 turns the condenser fan 115 off or maintains the condenser fan in an off or deactivated state (step 810). If the controller 160 determines that the discharge pressure is above the medium temperature threshold at decision point 806, it advances to decision point 808. If the discharge pressure is rising and above high pressure threshold, at step 812 the controller sets or maintains the fan speed at a high speed. By contrast, if the controller determines that the discharge pressure is rising and below the high pressure threshold, at step 814, the controller sets or maintains the condenser fan 115 at a normal speed.

If at decision point 802 the controller 160 determines that the discharge pressure is falling, in consecutive decision points 814, 816, 818, the controller 160 determines whether the output of the high side pressure transducer 205 indicates the discharge pressure is above the high pressure threshold, the medium pressure threshold, and the low pressure threshold. If the discharge pressure is not rising but is greater than either of the high pressure threshold and the medium pressure threshold, the controller 160 runs the condenser fan 115 at a high speed (step 820). If the controller 160 determines that the discharge pressure is below the medium temperature threshold at decision point 816, it advances to decision point 818. If the discharge pressure is not rising and above the low pressure threshold, at step 822 the controller 160 runs the condenser fan 115 at normal speed. By contrast, if the controller 160 determines that the discharge pressure is not rising and not greater than the low pressure threshold, at step 824, the controller turns the condenser fan 115 off.

The method 800 has several advantageous effects. When the compressor 112 is initially turned on, the discharge pressure will begin to rise so the answer to decision point 802 will be 'yes.' To allow the compressor to build a discharge pressure in the preferred operating range, decision points 804 and 806 will cause the fan 115 to remain off until the discharge pressure exceeds the medium pressure threshold. As the discharge pressure continues to rise the fan is operated at normal speed (step 814) until the discharge pressure exceeds the high pressure threshold at which point the fan will be switched to high speed (step 812). The combination of decision points 808, 816, 818 cause the controller 160 to maintain the high fan speed until eventually the fan 115 drives the discharge pressure below the medium pressure threshold. The method 800 prevents the fan from short-cycling at the high pressure threshold. After the compressor initially drives the discharge pressure past the high pressure threshold, the controller switches to high speed and maintains the fan there until the discharge pressure falls below the medium pressure threshold. If the compressor 112 remains on at this point, the discharge pressure will most likely remain above the low pressure threshold. Thus, the controller will continue to operate the condenser fan at a normal speed unless and until the discharge pressure again rises above the high pressure threshold. If the compressor turns off, discharge pressure will drop precipitously, eventually below the low pressure threshold, which causes the controller to turn off the condenser fan. The inventors believe that this fan cycling process can substantially improve ice maker performance and efficiency by better maintaining the refrigeration system at its optimum operating range. Moreover, the above described method 800 is made possible by the deploying the high side pressure transducer 205 as described above.

Figure 11:
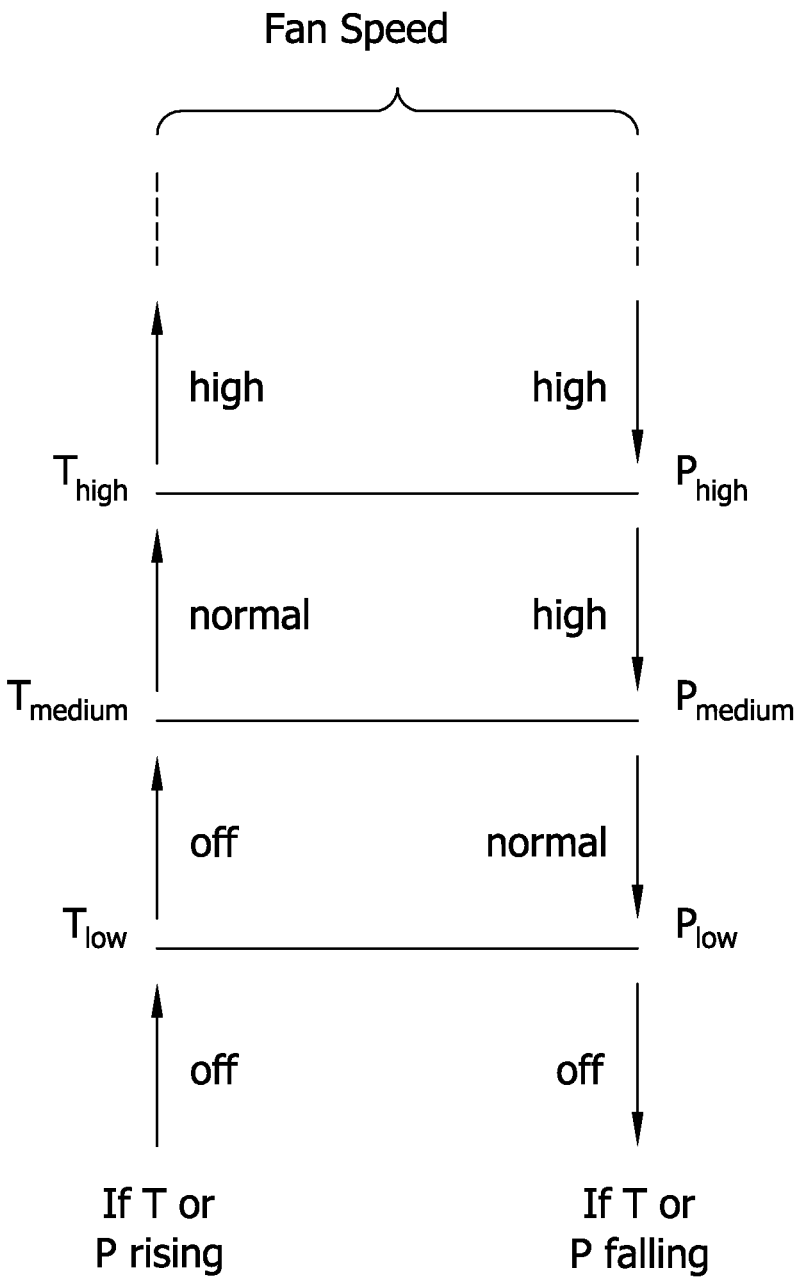
FIG. 11 is a schematic diagram of a method of cycling a condenser fan of an ice maker.

As shown in FIG. 11, it is contemplated that, the above-described fan-cycling routine could also be controlled on the basis of temperature T, as an alternative to pressure P, without departing from the scope of the disclosure. Whether temperature T or pressure P is chosen as a control input, there is a least a low input threshold $T_{low}$, $P_{low}$, a medium input threshold $T_{medium}$, $P_{medium}$, and a high input threshold $T_{high}$, $P_{high}$. When pressure P or temperature T is rising, the controller 160 is configured to maintain the condenser fan off unless the control input is greater than the medium control input $T_{medium}$, $P_{medium}$, operate the fan at a normal operating speed when the control input is between the medium threshold and the high threshold $T_{high}$, $P_{high}$, and operate the fan at a high speed when the control input is greater than the high threshold. When pressure or temperature is dropping, the controller is configured to operate the fan at a high speed as long as the control input is above the medium threshold $T_{medium}$, $P_{medium}$, operate the fan at a normal speed when the control input is between the low threshold $T_{low}$, $P_{low}$ and the medium threshold, and turn the fan off when the control input is below the low threshold. The inventors believe that temperature-based fan cycling control may be a viable option for ice makers intended to be sold at a lower price point such that integrated pressure transducers may not be an economical solution.

Referring to FIG. 2, in the illustrated embodiment, the control system further comprises a user interface device 220 that includes a display. For example, in one or more embodiments, the user interface device 220 comprises a local touch screen display that is mounted on the exterior of the ice maker 103. The controller 160 is connected to the user interface device 220 to receive user inputs to the interface device and to control the user interface device to display one or more display screens on the display.

Figure 9:
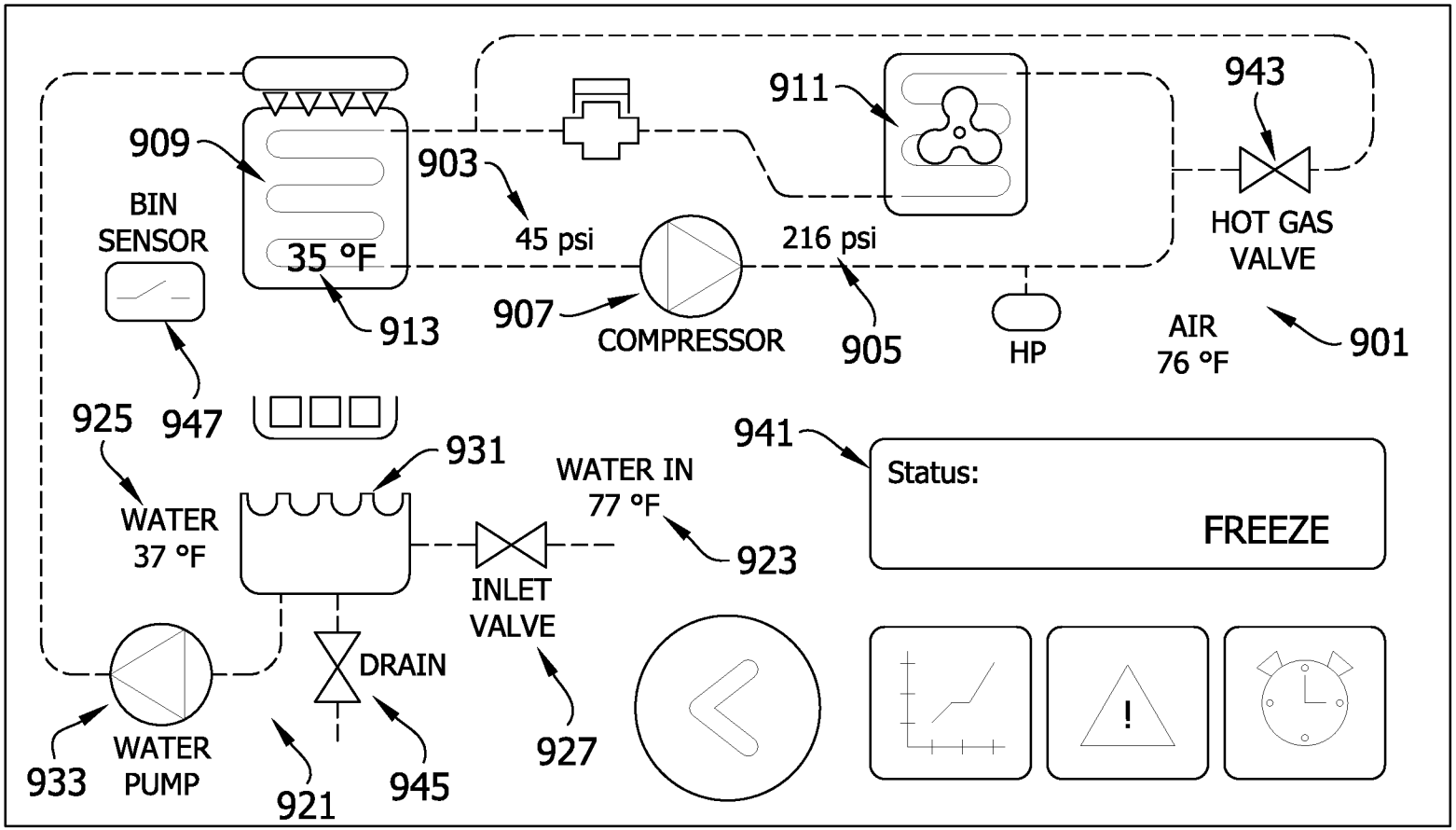
FIG. 9 is a screen shot of an ice maker status display screen of the ice maker.

Referring to FIG. 9, in the illustrated embodiment, the controller 160 is configured to selectively direct the user interface device 220 to display real-time indications 903, 905 of each of the suction pressure and the discharge pressure based on the signals output from each of the low side pressure transducer 203 and the high side pressure transducer 205, respectively. More particularly, the controller 160 is configured to selectively direct the user interface device 220 to display a schematic illustration of the refrigeration system 901 including a schematic illustration of the compressor 907, a schematic illustration of the evaporator 909, and a schematic illustration of the condenser 911. In the illustrated embodiment, the controller 160 directs the user interface 220 to display the real-time indication of the suction pressure 903 at a location between the schematic illustration of the evaporator 909 and the schematic illustration of the compressor 907 and to display the real-time indication of the discharge pressure 905 at a location between the schematic illustration of the compressor 907 and the schematic illustration of the condenser 911. Further, in the illustrated embodiment, the controller 160 is configured to display a real-time indication 913 of the temperature of the evaporator based on the output of the evaporator temperature sensor 223. In particular, the controller 160 directs the user interface device 220 to display the indication of the evaporator temperature 913 adjacent to (e.g., overlapping) the schematic illustration of the evaporator 909.

The controller 160 is further configured to direct the user interface device 220 to display a schematic illustration of the water system 921 adjacent the schematic illustration of the refrigeration system 901. That is, the user interface device 220 displays the schematic illustration of the water system 921 and the schematic illustration of the refrigeration system 901 simultaneously on the same display screen. In the illustrated embodiment, the controller 160 is further configured to display a real-time indication of water inlet temperature 923 based on the signal output from the water inlet temperature sensor 227. Further, the controller 160 is configured to display a real-time indication of sump water temperature 925 based on the signal output from the sump water temperature sensor 229. In the illustrated embodiment, the real-time indication of water inlet temperature 923 is displayed adjacent to a schematic illustration of a water inlet valve 927 and the real-time indication of the sump water temperature 925 is displayed adjacent to a schematic illustration of the sump 931.

In the illustrated embodiment, the controller 160 is further configured to cause the user interface device 220 to display status information about the ice maker on the same display screen with the schematic diagrams 901, 921 and the real time parametric indications 903, 905, 913, 923, 925. For example, the illustrated display screen includes an ice batch status indication 941 which displays the current step of the ice batch production process. In FIG. 8, the status indication 941 indicates that the ice maker 103 is currently executing a 'FREEZE' step. In one or more embodiments, the controller 160 is configured to update the status indication 941 to 'HARVEST,' 'PURGE,' and/or 'FILL' when the ice maker is performing those steps of an ice batch production process. The status indicator 941 could also display other general status information such as 'BIN FULL' to indicate that the ice bin is full of ice or 'STANDBY' if the ice maker 103 is currently inactive.

In addition to the status indication 941, the controller 160 directs the user interface device 220 to use color on the display screen to provide various additional status information. For example, in the illustrated example, each of the compressor illustration 907, the condenser illustration 911, the water inlet valve illustration 927, and a water pump illustration 933 are displayed in green, whereas a hot gas valve illustration 943, a bin sensor illustration 945, and a drain valve illustration 947 are all displayed in grey. In the illustrated embodiment, green color indicates that the respective component is active, whereas grey color indicates that the respective component is inactive. Accordingly, in one or more embodiments, in addition to displaying the real-time parametric information 903, 905, 913, 923, 925, the controller 160 is also configured to read the statuses of various components of the ice maker 103 and indicate the current statuses on the display screen (e.g., using color).

As explained above, the illustrated ice maker controller is configured to connect to a remote server 191, which in turn is configured to connect to one or more mobile devices 193. In an exemplary embodiment, the mobile device 193 is configured to run application software that presents the real-time status display of FIG. 9 on the display of the mobile device so that a user can remotely check the status of the ice maker 103. For instance, the ice maker 103 may be configured to periodically transmit the real-time measured operating parameter data from the control components 203, 205, 223, 225, 227, 229 and the status data regarding the components 112, 115, 118, 132, 140, 144 and the current generalized function of the ice maker 103 to the remote server 191 and the remote server is configured to transmit this data to the mobile device 193 upon request. Based on these data, the mobile device 193 can generate a display screen similar to the one shown in FIG. 9.

Figure 10:
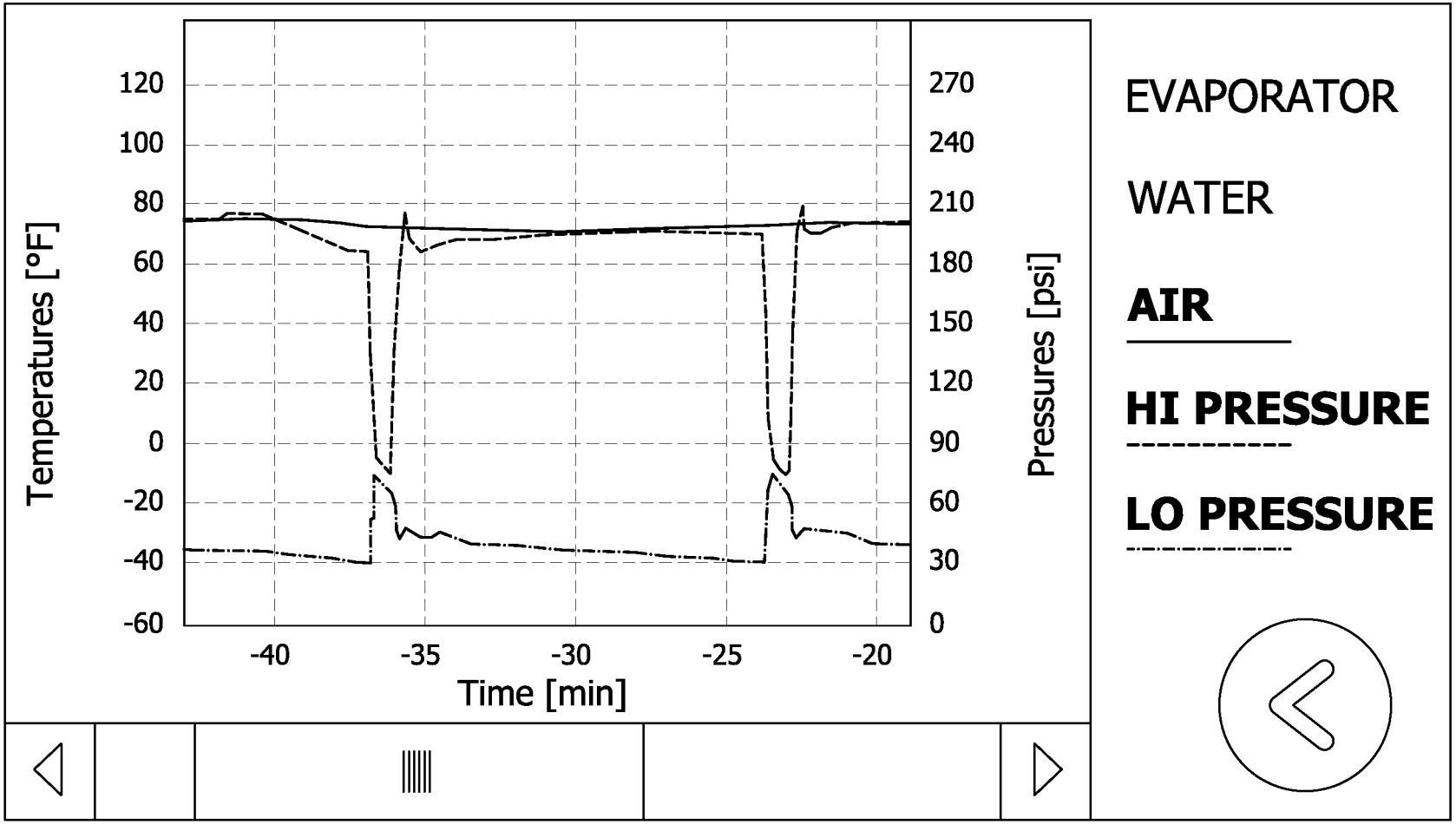
FIG. 10 is a screen shot of a historical operating parameter display screen of the ice maker.

Referring to FIG. 10, in the illustrated embodiment, the controller 160 is configured to store historical operating data from the sensors 203, 205, 223, 225, 227, 229 in the memory 164. In other words, the controller 160 is configured to store in memory records of the outputs of the low side pressure transducer 203, the high side pressure transducer 205, the evaporator temperature sensor 223, the air temperature sensor 225, the water inlet temperature sensor 227, and/or the sump temperature sensor 229 over a period of time (e.g., a period of time of at least 25 hours). The controller 160 is further configured to connect to a display device such as the user interface device 227 or the mobile device 193 (via the remote server 191) and selectively enable the display to display the record of the signals output from at least one of the low side pressure transducer 203 and the high side pressure transducer 205 over time. As shown in FIG. 10, in one or more embodiments, the display presents the historical operating data in chart form.

The inventors believe that the display concepts described above, particularly the ability to display real-time and historical information about the measured suction pressure and discharge pressure, yield substantial improvements to the servicing of the ice maker 103 in comparison with servicing methods employed in the prior art. Previously, when the performance of an ice maker deteriorated, a service technician would be called onsite to run diagnostic tests to make a determination of the source of the problem. The initial step was typically to connect a set of pressure gauges to the pressure taps and read the pressures while the ice maker is operating. As explained above, however, every time pressure gauges are connected to pressure taps, refrigerant charge is lost, and this loss can be damaging to the performance of a low-charge natural gas-refrigerant system of the type disclosed above.

Accordingly, in the illustrated embodiment, a service technician can conduct diagnostic testing without connecting pressure gauges to the ice maker, and thus without losing any refrigerant charge. In an exemplary method of servicing the ice maker 103, a technician runs the ice maker through a test procedure and reads at least one of the suction and discharge pressure indications 903, 905 from either the user interface device 220 or the mobile device 193 while running the testing procedure. For example, in an exemplary embodiment, the technician provides a control input to the display 220 or 193 that causes the ice maker 103 to run one or more ice batch production cycles. Then, while the ice maker 103 is running the ice batch production cycles, the technician reads the real-time suction and discharge pressures that are being displayed on the display 220 or 193 to diagnose the ice maker 103. For example, the technician can compare the suction and discharge pressure measurements to expected values for the icemaker to determine if refrigerant charge is low. The technician could also compare the discharge pressure measurement in particular to an expected value to determine whether the condenser fan is performing properly. Further, the technician could compare the suction pressure to an expected value and determine whether there is a restriction in the refrigeration system that is causing vacuum conditions on the suction line. No removable pressure gauge set is required to conduct a diagnostic test of the illustrated ice maker 103. Moreover, an entire diagnostic test can be performed without bleeding any refrigerant from the ice maker 103.

In another embodiment, a service technician can diagnose an ice maker 103 without the ice maker concurrently running. The technician uses the display of the user interface device 220 or the mobile device 193 to call up a display screen containing with an indication the suction and/or discharge pressure over a period of time, measured and recorded based on the signals output from the pressure transducers 203, 205. The technician reads the displayed data for past suction and/or discharge pressure from either the user interface device 220 or the mobile device 193 and makes a diagnostic assessment of the ice maker based on the displayed data.

In one or more embodiments, after making a diagnostic analysis as described above the service technician can take corrective action to address the issue that was diagnosed based on the suction or discharge pressures measured by the transducers 203, 205. In an exemplary embodiment, the technician makes user inputs to the user interface device 220 or the mobile device 193 that cause the controller to execute an automated maintenance routine. For example, if the servicing technician determines based on discharge pressure that the condenser is dirty, the technician can make inputs to the user interface device 220 or the mobile device 193 that force the controller to run an automated condenser cleaning routine. In one embodiment, as described in U.S. Patent Application Publication No. 2016/0327352, which is hereby incorporated by reference in its entirety, during the condenser cleaning routine, the controller 160 stops the compressor if running and drives the condenser fan 115 in the reverse direction at a high speed (e.g., a speed that is greater than the normal fan speed described above) to remove dust and other particulate from the condenser.

It can be seen that the above-described servicing method can be performed at the site of the ice maker 103 or remotely. For example, the network interface 170, network 190, and server 191 enable a technician to remotely control the ice maker 103 via the mobile device 193 to run one or more ice batch production cycles and monitor the outputs of the high and low side pressure transducers 203, 205.

In one or more embodiments, the ice maker 103 stores in the memory 164 threshold values associated with expected ranges for each of the suction and discharge pressures. If the controller 160 receives output from the high or low side pressure transducers 203, 205 indicating that one or both of the pressure measurements is outside of the expected range, the controller is configured to output an alarm. For example, the controller can use the network interface 170 to push a notification to the mobile device 193. Additionally, the controller 160 can direct the user input device 220 to display an alarm indication locally.

In the illustrated embodiment, the controller 160 is configured to trigger an alarm when the output of the high side pressure transducer 205 indicates a high side pressure that is greater than a predetermined alarm threshold for discharge pressure. Furthermore, the high pressure switch 199 is configured to automatically shut off the compressor 112 when the high side pressure exceeds a safety threshold that is greater than the predetermined alarm threshold for high side pressure. The high pressure switch 199 is configured to shutoff the compressor independently of the controller. Thus, in one or more embodiments, the high pressure transducer 205 enables the ice maker 103 to provide an early warning as the ice maker approaches an unsafe high pressure condition, but the high pressure switch 199 operates as hardwired fail-safe that prevents the ice maker from ever reaching a truly unsafe high pressure condition.

As will be appreciated by one skilled in the art, aspects of the embodiments disclosed herein may be embodied as a system, method, computer program product or any combination thereof. Accordingly, embodiments of the disclosure may take the form of an entire hardware embodiment, an entire software embodiment (including firmware, resident software, micro-code, etc.) or an embodiment combining software and hardware aspects that may all generally be referred to herein as a "circuit," "module" or "system." Furthermore, aspects of the disclosure may take the form of a computer program product embodied in any tangible medium having computer usable program code embodied in the medium.

Aspects of the disclosure may be described in the general context of computer-executable or processor-executable instructions, such as program modules, being executed by a computer or processor. Generally, program modules include routines, programs, objects, components, data structures, etc. that perform particular tasks or implement particular abstract data types. Aspects of the disclosure may also be practiced in distributed computing environments where tasks are performed by remote processing devices that are linked through a communications network. In a distributed computing environment, program modules may be located in both local and remote computer storage media including memory storage devices.

Any combination of one or more computer usable or computer readable medium(s) may be utilized. The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or flash memory), an optical fiber, a portable compact disc read-only memory (CDROM), an optical storage device, a transmission media such as those supporting the Internet or an intranet, or a magnetic storage device. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain or store the program for use by or in connection with the instruction execution system, apparatus, or device.

Computer program code for carrying out operations of the present disclosure may be written in any combination of one or more programming languages, including, but not limited to, an object oriented programming language such as Java, Smalltalk, C++, C # or the like and conventional procedural programming languages, such as the "C" programming language or similar programming languages. The program code may execute entirely on the portable electronic device, partly on the portable electronic device or refrigeration appliance, as a stand-alone software package, partly on the portable electronic device and partly on a remote computer, or entirely on a remote computer or server. In the latter scenario, the remote computer may be connected to the portable electronic device through any type of network, including a local area network (LAN) or a wide area network (WAN), or the connection may be made to an external computer (for example, through the Internet using an Internet Service Provider).

When introducing elements of the present disclosure or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the disclosure are achieved and other advantageous results attained.

As various changes could be made in the above products and methods without departing from the scope of the disclosure, it is intended that all matter contained in the above description shall be interpreted as illustrative and not in a limiting sense.

What is claimed is:

1. An ice maker comprising:

an ice formation device in which to form ice;

a water system configured to deliver water to the ice formation device;

a refrigeration system including a compressor, a condenser, an evaporator, a thermal expansion device, and refrigerant passaging connecting the compressor, the condenser, the evaporator, and the thermal expansion device, the evaporator being thermally coupled to the ice formation device to cool the ice formation device for forming at least some of the water delivered by the water system into ice; and a control system configured to control the refrigeration system and the water system to form ice in the ice formation device, the control system including a controller, a low side pressure transducer fluidly connected to the refrigerant passaging upstream of the compressor, and a high side pressure transducer fluidly connected to the refrigerant passaging downstream of the compressor, the low side pressure transducer being configured to output to the controller a signal representative of a suction pressure of the refrigeration system and the high side pressure transducer configured to output to the controller a signal representative of a discharge pressure of the refrigeration system;

wherein the refrigeration system is hermetically sealed and is devoid of any pressure taps at which any servicing pressure gauge can be fluidly connected to the refrigerant passaging.

2. The ice maker as set forth in claim 1, wherein the refrigeration system is charged with natural gas refrigerant.

3. The ice maker as set forth in claim 2, wherein the natural gas refrigerant is r290.

4. The ice maker as set forth in claim 2, wherein the natural gas refrigerant has a total charge of less than 150 g.

5. The ice maker as set forth in claim 1, wherein the control system further comprises a display, the display connected to the controller, the controller being configured to selectively direct the display to display a real-time indication of each of the suction pressure and the discharge pressure based on the signals output from the low side pressure transducer and the high side pressure transducer, respectively.

6. The ice maker as set forth in claim 5, wherein the display comprises a local display mounted on the ice maker.

7. The ice maker as set forth in claim 5, wherein the controller is configured to selectively direct the display to display a schematic illustration of the refrigeration system including a schematic illustration of the compressor, a schematic illustration the evaporator, and a schematic illustration the condenser, and to display the real-time indication of the suction pressure at a location between the schematic illustration of the evaporator and the schematic illustration of the compressor and display the real-time indication of the discharge pressure at a location between the schematic illustration of the compressor and the schematic illustration of the condenser.

8. The ice maker as set forth in claim 7, wherein the control system further comprises an evaporator temperature sensor configured to output to the controller a signal representative of a temperature of the evaporator and wherein the controller is configured to display a real-time indication of the temperature of the evaporator based on the signal output from the evaporator temperature sensor adjacent the schematic illustration of the evaporator.

9. The ice maker as set forth in claim 7, wherein the controller is configured to direct the display to display a schematic illustration of the water system adjacent the schematic illustration of the refrigeration system.

10. The ice maker as set forth in claim 9, wherein the control system includes one or more temperature sensors associated with the water system, each configured to output to the controller a signal representative of a water temperature, the controller being configured to display, adjacent to the schematic illustration of the water system, a real-time indication of each water temperature based on the signal output from each of the one or more temperature sensors.

11. The ice maker as set forth in claim 1, wherein the control system comprises a network interface, the controller configured to transmit indications of each of the low side pressure and the high side pressure based on the signals output from the high side pressure transducer and the low side pressure transducer, respectively, to a remote device via the network interface.

12. The ice maker as set forth in claim 1, wherein each of the high side pressure transducer and the low side pressure transducer is connected to the refrigerant passaging by a tee joint.

13. The ice maker as set forth in claim 12, wherein the refrigerant tubing comprises copper tubing and each tee joint comprises a brazed tee joint.

14. The ice maker as set forth in claim 1, wherein each of the high side pressure transducer and the low side pressure transducer is connected to the refrigerant tubing by a brazed joint.

15. The ice maker as set forth in claim 1, wherein the controller is configured to actuate the water system to deliver water to the ice formation device based on the signal output from the low side pressure transducer.

16. The ice maker as set forth in claim 1, wherein the refrigeration system comprises a condenser fan, wherein the controller is configured to cycle the condenser fan based on the signal output from the high side pressure transducer.

17. The ice maker as set forth in claim 16, wherein the controller is configured to determine whether the discharge pressure is falling or rising based on the signal output from the high side pressure transducer.

18. The ice maker as set forth in claim 17, wherein the controller is configured to adjust the condenser fan differently depending on whether the high side pressure is determined to be rising or falling.

19. The ice maker as set forth in claim 16, wherein the controller is configured to selectively adjust a speed of the condenser fan based on the signal output from the high side pressure transducer.

20. The ice maker as set forth in claim 19, wherein the controller is configured to selectively adjust the fan between a high speed, normal speed, and off based on the signal output from the high side pressure transducer.

21. The ice maker as set forth in claim 1, further comprising a high pressure switch fluidly connected to the refrigerant passaging downstream of the compressor.

22. The ice maker as set forth in claim 21, wherein the controller is configured to trigger an alarm when the signal output from the high side pressure transducer indicates a high side pressure that is greater than a predetermined alarm threshold for discharge pressure.

23. The ice maker as set forth in claim 22, wherein the high pressure switch is configured to shut off the compressor when the high side pressure exceeds a safety threshold that is greater than the predetermined alarm threshold for discharge pressure.

24. The ice maker as set forth in claim 23, wherein the high pressure switch is configured to shutoff the compressor independently of the controller.

25. The ice maker as set forth in claim 1, wherein the controller is configured to store in memory records of the outputs of the low side pressure transducer and the high side pressure over time.

26. The ice maker as set forth in claim 25, wherein the controller is configured to connect to a display and is configured to selectively direct the display to display the record of the output of at least one of the low side pressure transducer and the high side pressure over time.

27. The ice maker as set forth in claim 1, wherein each of the high side pressure transducer and the low side pressure transducer is a pre-manufactured, permanent component of the refrigeration system.

* * * * *